US008875463B2

(12) United States Patent
Plagemann et al.

(10) Patent No.: US 8,875,463 B2
(45) Date of Patent: Nov. 4, 2014

(54) SIDING SYSTEM

(71) Applicant: Tecton Products, LLC, Fargo, ND (US)

(72) Inventors: Robert P. Plagemann, Fargo, ND (US); Mark Bratton, Fargo, ND (US); Robb Willgohs, West Fargo, ND (US)

(73) Assignee: Tecton Products, LLC, Fargo, ND (US)

( * ) Notice: Subject to any disclaimer, the term of this patent is extended or adjusted under 35 U.S.C. 154(b) by 0 days.

(21) Appl. No.: 13/772,162

(22) Filed: Feb. 20, 2013

(65) Prior Publication Data

US 2014/0053491 A1 Feb. 27, 2014

Related U.S. Application Data

(60) Provisional application No. 61/601,210, filed on Feb. 21, 2012.

(51) Int. Cl.
*E04D 1/12* (2006.01)
*E04C 2/30* (2006.01)
*E04B 2/00* (2006.01)

(52) U.S. Cl.
CPC .... *E04C 2/30* (2013.01); *E04C 2/46* (2013.01)
USPC ..... 52/559; 52/543; 52/546; 52/553; 52/555

(58) Field of Classification Search
USPC ..... 52/518–528, 545, 546, 748.1, 459–462, 52/464, 466, 468, 535, 543, 553–555, 52/557–559
See application file for complete search history.

(56) References Cited

U.S. PATENT DOCUMENTS

| | | | | |
|---|---|---|---|---|
| 3,977,145 | A * | 8/1976 | Dobby et al. | 52/531 |
| 4,669,238 | A * | 6/1987 | Kellis et al. | 52/105 |
| 5,537,792 | A * | 7/1996 | Moliere | 52/531 |
| 6,050,041 | A * | 4/2000 | Mowery et al. | 52/520 |
| 6,367,220 | B1 * | 4/2002 | Krause et al. | 52/512 |
| 6,393,792 | B1 * | 5/2002 | Mowery et al. | 52/520 |
| 6,715,250 | B2 * | 4/2004 | Bryant et al. | 52/528 |
| 6,874,290 | B1 * | 4/2005 | Bokan | 52/543 |
| 6,955,019 | B2 * | 10/2005 | Donlin et al. | 52/520 |
| 7,478,507 | B2 * | 1/2009 | Krause | 52/546 |
| 7,698,864 | B2 * | 4/2010 | Justice et al. | 52/519 |
| 7,856,790 | B2 * | 12/2010 | Jambois et al. | 52/748.1 |
| 8,117,801 | B2 * | 2/2012 | Jambois et al. | 52/748.1 |

* cited by examiner

*Primary Examiner* — Brian Glessner
*Assistant Examiner* — Beth Stephan
(74) *Attorney, Agent, or Firm* — Schwegman Lundberg & Woessner, P.A.

(57) ABSTRACT

A building product for attachment to a surface of a building includes a plurality of siding members, and a plurality of spacers, wherein the siding members and spacers are assembled to resemble a plurality of individual siding shingles.

8 Claims, 6 Drawing Sheets

SIDING SYSTEM

PRIORITY OF INVENTION

This application claims priority of invention under 35 U.S.C. §119(e) of U.S. Provisional Application No. 61/601,210, filed Feb. 21, 2012, which is incorporated herein by reference in its entirety.

FIELD

This application relates generally to pultruded products and more specifically to a pultruded building siding product.

BACKGROUND

Siding on residential and light-commercial buildings is typically made of wood, vinyl or other polymeric materials, and fiber cement. Wood is not considered "low maintenance" as it is susceptible to warp, rot, infestation, and requires frequent repainting or staining. Vinyl or a polymeric siding requires attachment methods to the exterior sheathing that accommodate its movement due to high coefficient of thermal expansion (CTE). This is often accomplished by creating attachment slots of ample width in the siding and allowing the fasteners to "float" within this slot. Warping due to large CTE is one of the chief drawbacks of these siding materials. Vinyl and other polymeric type of sidings are also susceptible to additional warping because of thermoplastic's low heat deflection temperature. Solar heat gain of thermoplastic siding also must be minimized to prevent higher surface temperatures, which will soften the siding and create the potential for permanent deformation and/or warp. To reduce solar heat gain, thermoplastic siding is typically sold in light reflecting colors like white and pastels. Dark colored thermoplastic siding may reach temperatures that exceed its heat deflection temperature due to solar heat gain.

Siding manufactured from fiber cement is heavy and is relatively brittle, making it difficult to handle and install. Fiber cement siding absorbs water and when exposed to water may create conditions that both deteriorates the material and affects its coating performance and durability. Additionally, fiber cement siding is free-floating, with no interlocks or self-aligning mechanism included with the siding.

Shakes and shingle siding have historical roots in siding, but are broadly popularized as an accent used in concert with other siding designs, and is found in many regions of the country. When used in conjunction with lap siding, similar to vertical, shingle style performs an alternative design function.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present siding system imitates the aesthetic aspects of traditional wood shingle designs.

Figure 1:
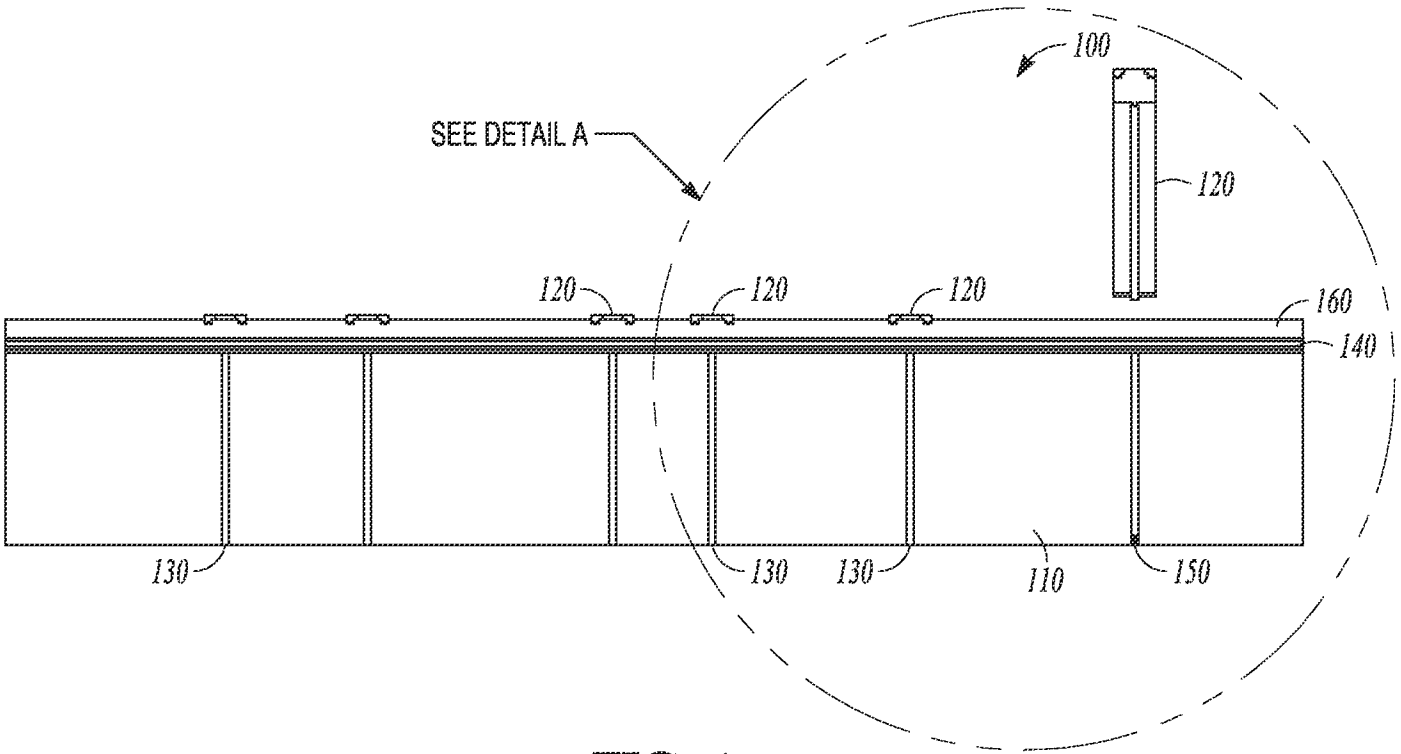
FIG. 1 shows a front view of siding assembly with a piece of slotted lap siding, in accordance with one embodiment.
Figure 2:
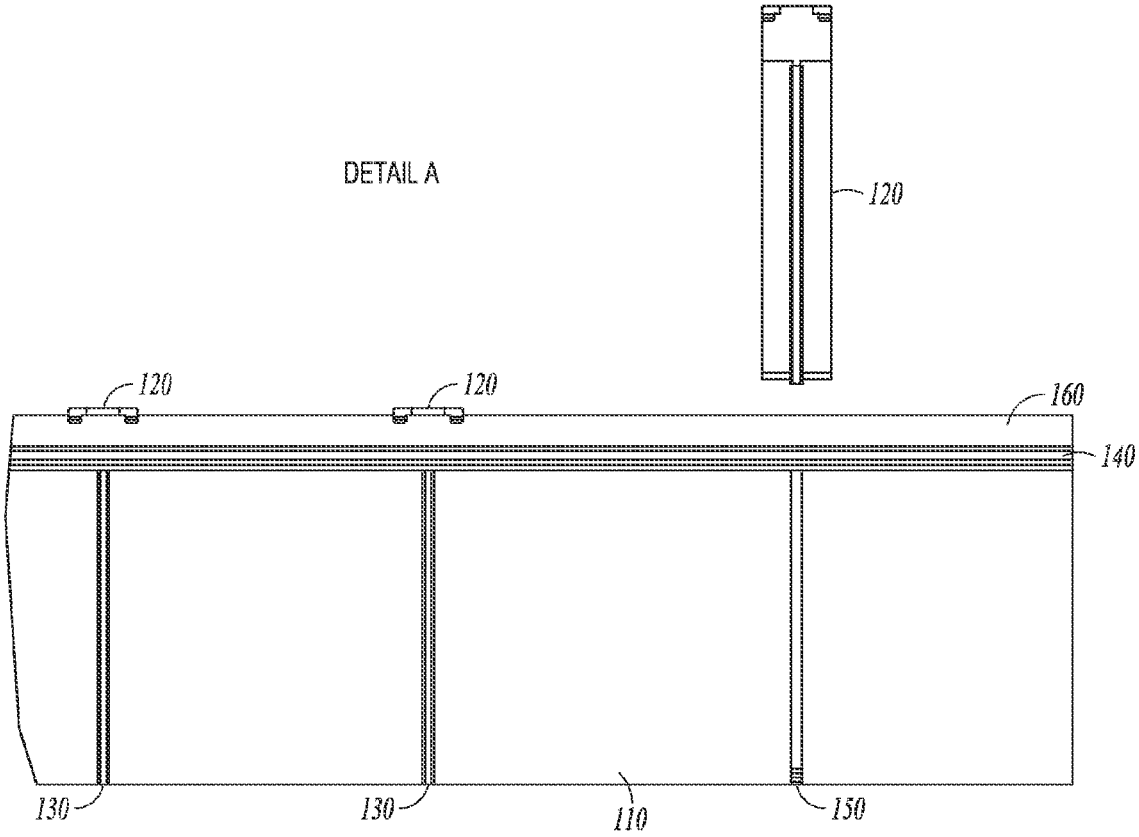
FIG. 2 shows Detail A of FIG. 1 and an enlarged view of the shingle slot spacer assembly.

FIG. 1 shows a front view of siding assembly 100, in accordance with one embodiment, and FIG. 2 shows a detail of a portion of FIG. 1. Siding assembly 100 generally includes a slotted lap siding member 110 and a plurality of spacers 120. Siding assembly 100 is for configured for attachment to a surface of a building. In use, a plurality of siding members 110 are used to form a wall covering. When assembled, the siding members 110 and spacers 120 are assembled to resemble a plurality of individual siding shingles.

The siding member 110 includes a plurality of slots 130 to give the appearance of shingles, and the spacers 120 are inserted into each of the slots 130. In this example, the assembled siding members 110 and spacers 120 make a single row panel of shingles. The slots 130 can be formed at almost any distance apart from each other for any given desired design Siding member 110 can be a pultruded siding member formed of a fiber reinforced composite. A top interlock 140 and a bottom interlock 150 are configured to interlockingly mate when two siding members 110 are put together. Each of the bottom and top interlocks are generally U-shaped portions with the top interlock 140 extending outwardly from the front of the siding member 110 with the U-shape facing down and the bottom interlock 150 extending rearwardly from the siding member 110 with the U-shape facing up. Siding member 110 can further include a nailing fin 160 extending above the top of the siding member for fastening the siding member to a structure.

In one example, each of the plurality of slots 130 does not extend through the entire height of the siding member 110. In this way, a portion of the top of the siding member at the nailing fin 160 and a portion of the bottom of the siding member 110 at the bottom interlock 150 remains intact. This provides extra strength.

Figure 3:
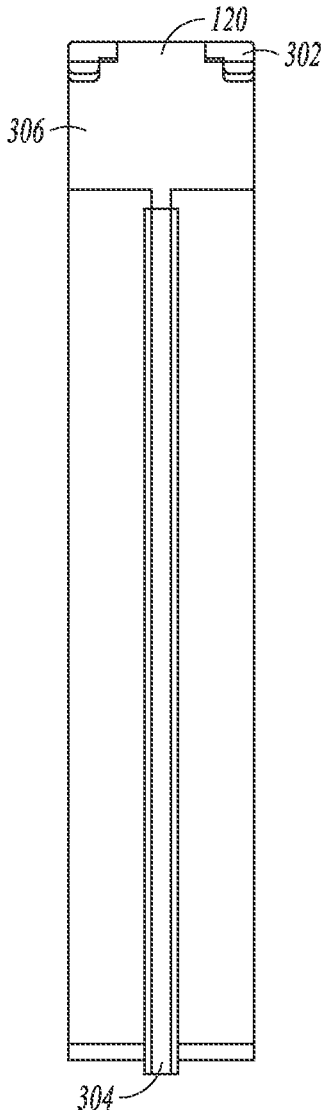
FIG. 3 shows a front view of a shingle slot spacer, in accordance with one embodiment.
Figure 4:
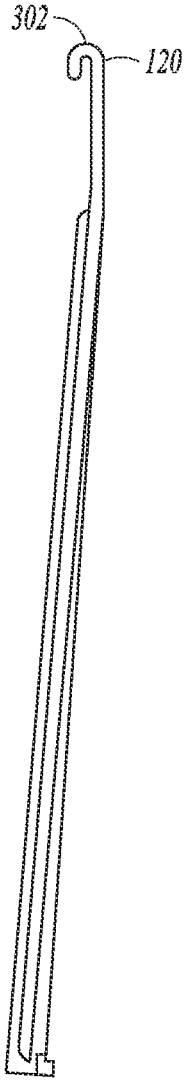
FIG. 4 shows a side view of the shingle slot spacer, in accordance with one embodiment.
Figure 5:
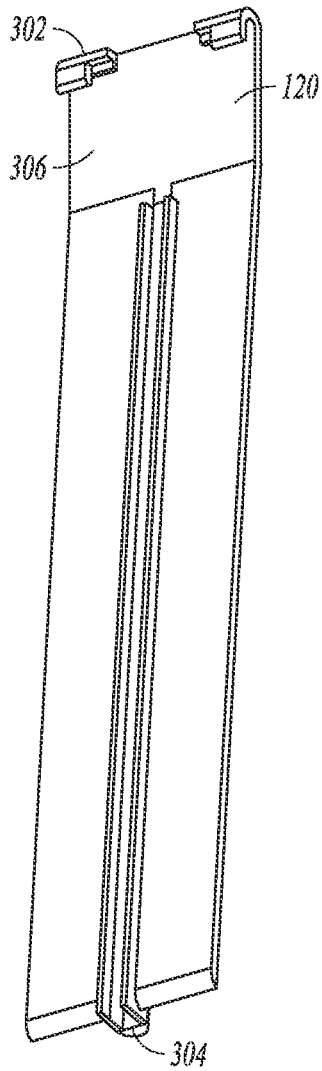
FIG. 5 shows an isometric view of the shingle slot spacer, in accordance with one embodiment.

FIG. 3 shows a front view of the spacer 120; FIG. 4 shows a side view of the spacer; and FIG. 5 shows an isometric view of the spacer, in accordance with one embodiment.

Spacer 120 includes a top hook 302 that engages with the top of the nailing fin 160 of the siding member (See FIG. 1). A nailing fin portion 306 is located behind the nailing fin 160, when assembled. A bottom insert 304 extends along the rest of the length of the spacer 120. Bottom insert 304 is dimensioned to fit within the slots 130 of siding member 110. In one example, the spacer 120 can be made by injection molding.

Figure 6:
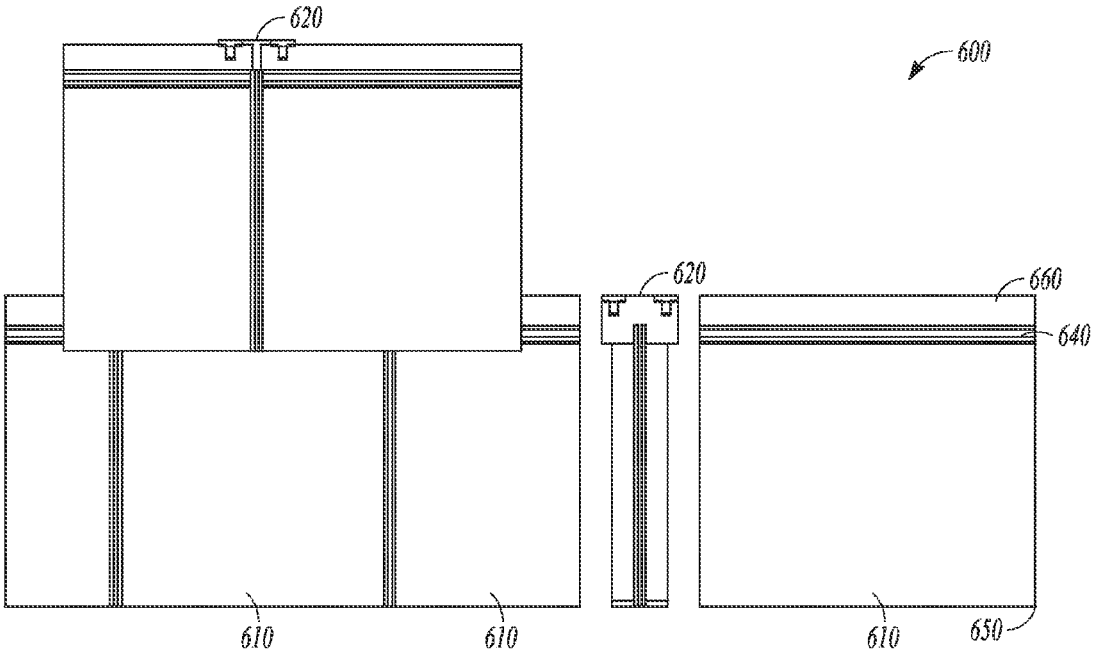
FIG. 6 shows an assembly of the abutted spacer and lap siding cut to a common shingle width.
Figure 7:
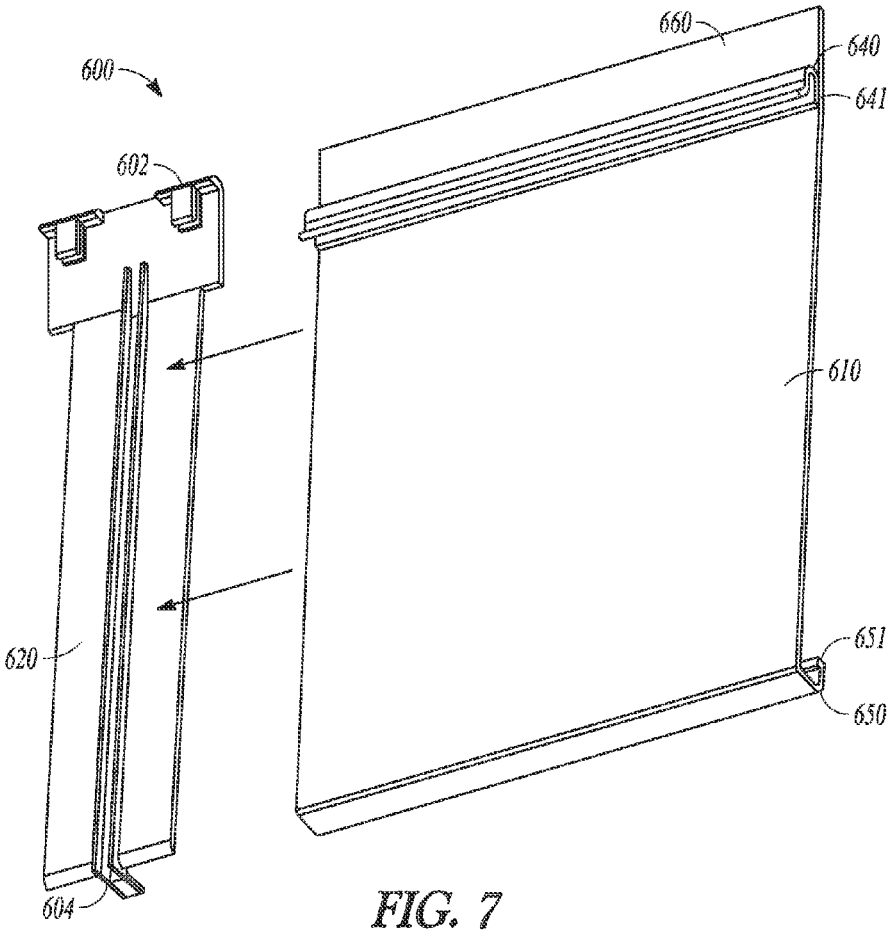
FIG. 7 shows an isometric view of the abutted spacer and lap siding cut to a common shingle width.

FIG. 6 shows a siding assembly 600, and FIG. 7 shows an isometric view of the siding assembly 600, in accordance with one embodiment.

Siding assembly 600 generally includes a plurality of siding members 610 and a plurality of spacers 620. The siding members 610 and spacers 620 are assembled to resemble a plurality of individual siding shingles.

In this example, the siding members 610 do not include slots. Instead, the siding members 610 are cut to the width of various shingle sizes and the spacers 620 are sandwiched between adjacent siding members 610 and abutted to each.

Similar to the siding assembly discussed above, each siding member 610 includes a top interlock 640, a bottom interlock 650, and a nailing fin 660. Each of the bottom and top interlocks 640, 650, can include an inwardly protruding lip 641, 651 that extend along their lengths. These lips 641 and 651 help two siding members 610 (or siding member 110, discussed above) interlock together when the two are connected together with a bottom interlock 650 mating with a top interlock 640.

Figure 8:
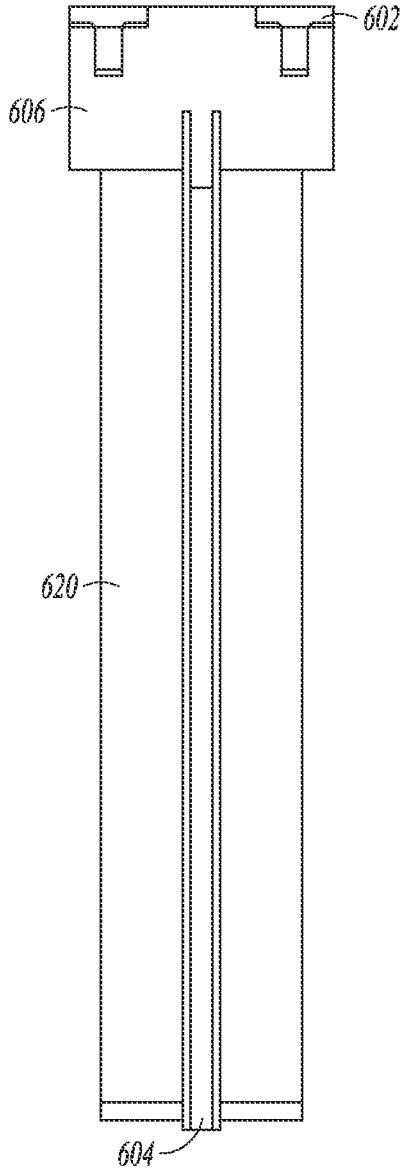
FIG. 8 shows front view of an abutted spacer, in accordance with one embodiment.
Figure 9:
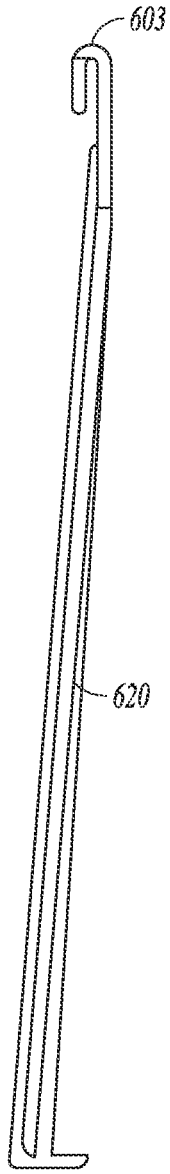
FIG. 9 shows a side view of the abutted spacer of FIG. 6.

FIG. 8 shows front view of an abutted spacer 620, in accordance with one embodiment; and FIG. 9 shows a side view of the abutted spacer 620.

Spacer 620 includes a top hook 602 that engages with the top of the nailing fin 660 of the siding member 610 (See FIG. 7). A nailing fin portion 606 is located behind the nailing fin 660, when assembled. A bottom insert 604 extends along the rest of the length of the spacer 620. In one example, the spacer 620 can be made by injection molding.

Figure 10:
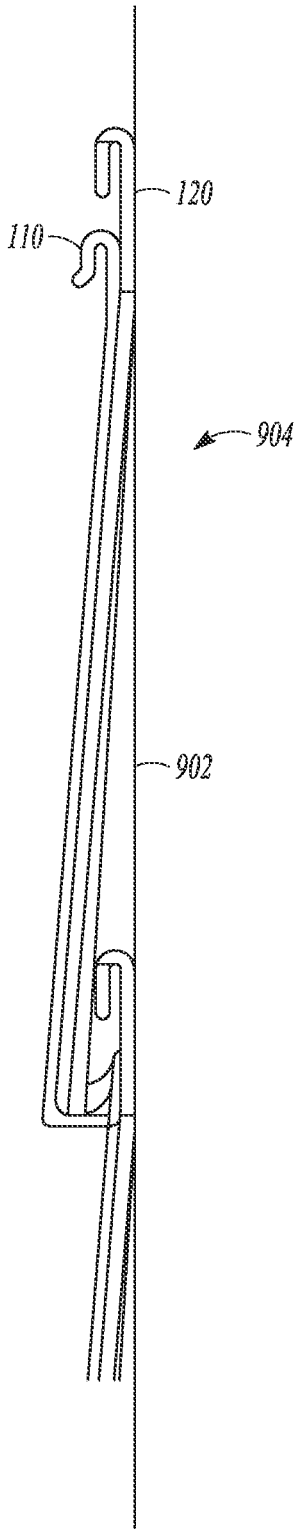
FIG. 10 shows a side of either assembly indicating the water management system that is created, in accordance with one embodiment.

FIG. 10 shows a side of either assembly 100, 600 indicating the water management system that is created. Here, the assembled siding member 110 and spacers 120 are configured to provide a water management system when installed over an air/water barrier 902 which is installed over sheathing 904. Because the spacers 120 are behind siding members 110, the spacers 120 keep the siding members 120 from contacting the attached surface. This allows water to run down the surface in the spaces between adjacent spacers 120.

To install either of the embodiments discussed above, the spacer 120 is placed properly onto the siding member 110 (either abutting or within the slots). The siding member is fastened to the exterior of the structure using nails or screws through the nailing fin of the siding member. A second siding member is prepared with a spacer and is interlocked with the first siding member and then fastened to the structure. The process is repeated until the wall is surfaced.

Overview

In one embodiment, a pultruded lineal lap siding product, adapted to be the exterior siding of a building with the appearance of a shingle style. The pultruded product is fabricated with slots at several random distances to create the appearance of shingles. An injection molded spacer is inserted into the random shingle slots to finish the aesthetic need and also to incorporate a water management system. An optional method is to cut the pultruded lap siding product through to a common shingle width and abut to an alternative injection molded spacer.

In each method, the top hook and bottom insert of the injection molded spacers aid in the fastening and alignment with the fabricated pultruded siding component. The pultruded product is configured to mate with a joint member of a second pultruded product mounted horizontally adjacent the pultruded product.

In various embodiments, the design variables for siding members are numerous and are regional in preference, such as smooth or rough-sawn surface texture; thin or ½" thick butts. Application designs may have lap exposures of 4, 5, 6 and 7 inches, for example. Shingle edge matching are also numerous and include butt-line or staggered butt-lines; butt edge or keyway. Keyway, cut down, or exposed edge shingles will need edges to match surface finish color.

Panelized shingles provide a site labor advantage compared to the installation of individual shingles. 2×4 foot shingle panels are a popular size, however the number points of fastening is limited to the edges of the panel. Single row panels that are of greater lengths (10-16 feet) long are also available and allow fastening along its entire top edge. The single row panels are believed to perform better from a wind loading performance standpoint.

Additional Notes

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

What is claimed is:

1. A building product for attachment to a surface of a building, the building product comprising:

a plurality of siding members each having a plurality of vertical slots exposed on a front surface of the siding member; and a plurality of spacers, wherein the siding members and spacers are assembled with the spacers oriented vertically on a building within the plurality of vertical slots on each of the siding members such that the siding members resemble a plurality of individual siding shingles.

2. The building product of claim 1, wherein each of the siding members includes the plurality of slots to give the appearance of shingles and wherein the spacers are inserted into each of the slots, wherein assembled siding members and spacers make a single row panel of shingles.

3. The building product of claim 2, wherein each of the plurality of slots is shorter than a height of each of the siding members such that each of the plurality of slots does not extend through the entire height of each of the siding members such that a portion of the top of the siding member and a portion of the bottom of the siding member remains intact.

4. The building product of claim 1, wherein each of the siding members includes top and bottom interlocking members.

5. The building product of claim 1, wherein each of the siding members is cut to the width of various cedar shingle sizes.

6. The building product of claim 5, wherein the spacers abut each of the siding members.

7. The building product of claim 1, wherein the assembled siding members and spacers are configured to provide a water management system when installed over an air/water barrier which is installed over sheathing.

8. The building product of claim 1, wherein each of the siding members includes a texture.

* * * * *